United States Patent [19]

Matthews

[11] 3,948,203

[45] Apr. 6, 1976

[54] MULTIPLE POINT SECURING CLEAT

[76] Inventor: Joseph E. Matthews, 4017 N. Witchduck, Virginia Beach, Va. 23455

[22] Filed: May 9, 1975

[21] Appl. No.: 576,185

[52] U.S. Cl. ..... 114/218

[51] Int. Cl.[2] ..... B63B 21/04

[58] Field of Search..... 114/218; 24/115 H, 115 J, 24/115 K, 129 R

[56] References Cited

UNITED STATES PATENTS

| | | | |
|---|---|---|---|
| 1,034,222 | 7/1912 | Dych | 114/218 |
| 3,126,858 | 3/1964 | Rosinski | 114/218 |
| 3,715,782 | 2/1973 | Newell | 114/218 |

*Primary Examiner*—Trygve M. Blix
*Assistant Examiner*—Stuart M. Goldstein
*Attorney, Agent, or Firm*—Robert G. McMorrow

[57] ABSTRACT

A cleat for multiple point attachment has mounting bases with spaced apart pedestals supporting a main body. The main body includes a central section, and inner and outer wing sections, the main body being of gull wing form. Projecting upwardly from the gull wing main body is an annular peg. Multiple line attachments are facilitated by this arrangement.

4 Claims, 4 Drawing Figures

MULTIPLE POINT SECURING CLEAT

BACKGROUND OF THE INVENTION

1. Field of the Invention

This invention pertains to mooring cleats and similar securing devices, employed in vessel dockage, material tie downs, and the like.

2. Statement of the Prior Art

Cleats as previously proposed have been embodied in numerous and varied configurations. Among these, and representative of such shapes and forms, are those shown in the below listed U.S. patents:

| Patentee | Patent No. | Issue Date |
|---|---|---|
| Rosinski | 3,126,858 | March 31, 1964 |
| Granger | 533,193 | Jan. 29, 1895 |
| Dych | 1,034,222 | July 30, 1912 |
| Keating | 2,350,767 | June 6, 1944 |
| Brydon | 2,836,141 | May 27, 1958 |

SUMMARY OF THE INVENTION

The principal objective of the present invention resides in the provision of a cleat having a maximum capability for types and forms of line connections thereto. The cleat is effective in mooring line situations, combined mooring and spring lines, connection of an anchor line, and the like.

The cleat is of heavy metallic construction and includes mounting bases adapted for secure application to a support surface.

The unit includes a peg which is co-actively associated with cleat wings in various line connection functions. The wings are angularly disposed in special relation to one another to achieve the securing functions.

Other and further objects and advantages of the invention will become apparent to those skilled in the art from a consideration of the following specification when read in conjunction with the annexed drawing.

DESCRIPTION OF THE PREFERRED EMBODIMENT

Figure 1:
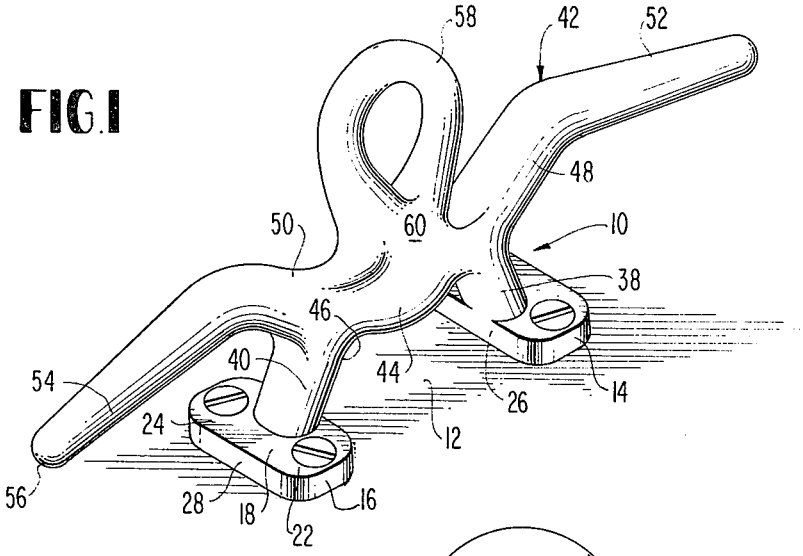
FIG. 1 is a perspective view of a multiple point securing cleat constructed and assembled in accordance with the teachings of this invention.
Figure 2:
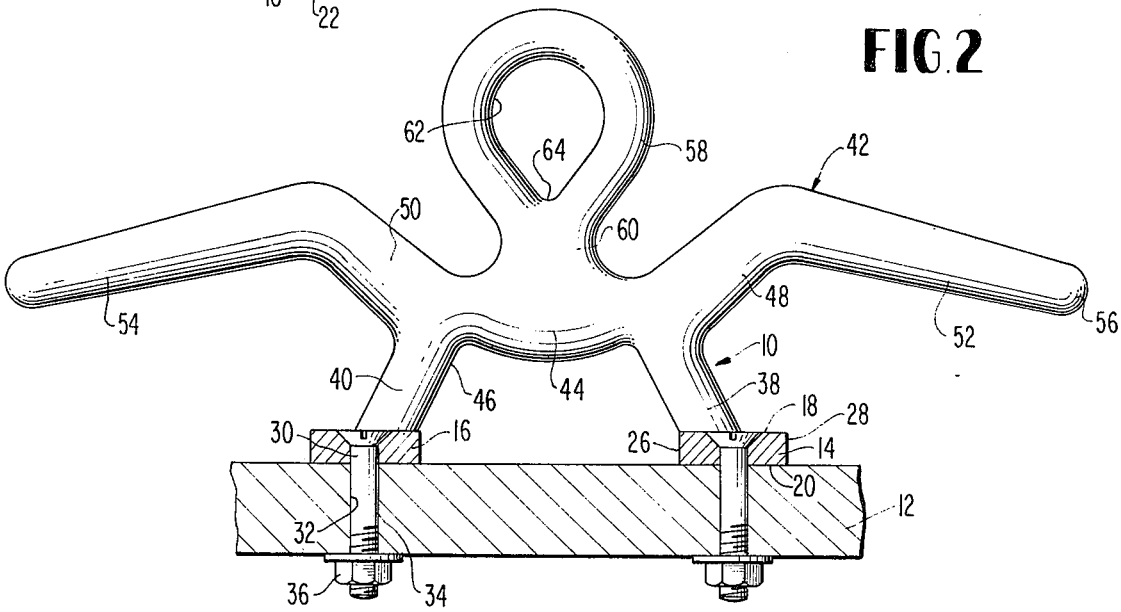
FIG. 2 is an enlarged side elevational view partially in cross section.

In FIGS. 1 and 2 the multiple point securing cleat 10 of this invention is shown. The cleat 10 is affixed to a deck 12 or other supporting surface as described hereinafter. Employed in the mounting operation are a pair of mounting bases 14, 16 each having a top side 18 and a lower side 20. These bases extend transversely to the main extent of the cleat, and have end sections 22, 24 on either side thereof, and inner and outer side edges 26 and 28, respectively. Each of the end sections has a vertical, countersunk opening 30 formed therein and extending therethrough from its top side 18 to its lower side 20. The deck 12 is provided with co-aligned holes 32, and bolts 34 extend therethrough. These bolts have nut and washer assemblies 36 which lockingly engage the mounting bases to the deck.

Projecting integrally upwardly from each of the bases are pedestals 38 and 40. The pedestals are of rounded cross section and are angularly inclined toward one another. The pedestals extend from the bases at mid-point positions between the bolt locations to strengthen the unit.

An elongated main body assembly 42 extends across the pedestal and includes a curvilinear central section 44 which spans the pedestals. The central section is downwardly concave and is of maximum depth at its mid-length location. The central section and pedestals define a central arch opening 46 of the cleat.

The main body further includes inner wing sections 48 and 50 which extend upwardly and outwardly from the central section. Such sections are again of integral cast formation. Extending in turn from the inner wing sections are outwardly and downwardly angled outer wing sections 52, 54. These are of substantially greater length than the inner wing sections, and terminate in rounded distal extremities 56.

Figure 3:
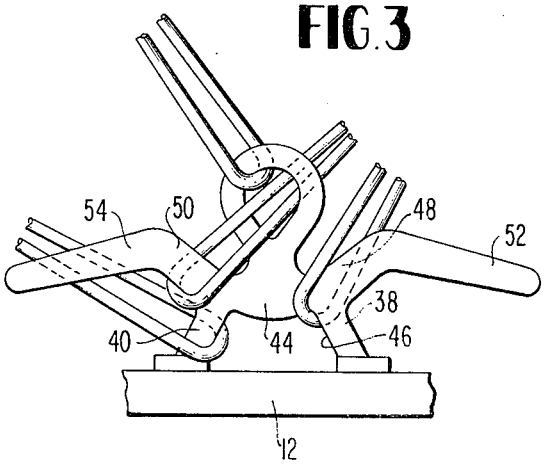
FIGS. 3 and 4 are elevational views on reduced scale showing various possible line connections.
Figure 4:
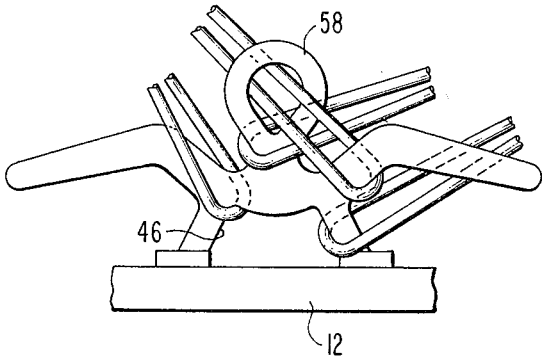

Finally, and of substantial importance to the operation of the cleat in most instances, a central vertical peg 58 extends vertically from the central section. The peg has an enlarged peg base 60 integral with said central section, and is substantially annular in form. The peg opening 62 has a pointed lower section 64 which facilitates certain types of line connections (FIGS. 3 and 4).

In the latter figures, various line connections to the cleat, which may be separately or cumulatively undertaken, are shown. In nautical terminology, the peg 58 may be employed as a fair lead or pad eye, or it may be used also in the application of a pad lock to a line or chain. Various other uses of the cleat in line connections are shown. The gull wing design permits two lines to be secured about the cleat in FIG. 8 form from the neck to the wings and to run in two directions at the same time. Many other adaptations of the cleat and its employment with lines will occur to those skilled in the art.

I claim:

1. A cleat comprising:

a pair of mounting bases adapted for securing to a surface;

means securing the mounting bases to the surface;

angular supporting pedestals projecting upwardly toward one another from the mounting bases;

an elongated main body extending across the pedestals, the main body including a central section spanning the pedestals, upwardly and outwardly extended inner wing sections on each side of the central section, and an outwardly and downwardly inclined outer wing section on each of the inner wing sections; and an annular peg projecting vertically from the central section.

2. The invention of claim 1, wherein:

the central section is curvilinear, and is of maximum depth at substantially its mid-point.

3. The invention of claim 1, wherein:

the components of the cleat are integral.

4. The invention of claim 1, wherein:

the outer wing sections are of greater length than the inner wing sections.

* * * * *